US006626737B1

(12) United States Patent
Ullens de Schooten

(10) Patent No.: US 6,626,737 B1
(45) Date of Patent: Sep. 30, 2003

(54) MACHINE TO PRODUCE AND PROPEL SUBLIMABLE SOLID PARTICLES

(76) Inventor: Pascal Ullens de Schooten, Rue de Perit By 16, B-5030 Sauveniara (BE)

( * ) Notice: Subject to any disclaimer, the term of this patent is extended or adjusted under 35 U.S.C. 154(b) by 0 days.

(21) Appl. No.: 10/122,054

(22) Filed: Apr. 12, 2002

(51) Int. Cl.[7] ..... B24B 1/08

(52) U.S. Cl. ..... 451/38; 39/100; 62/320; 62/605

(58) Field of Search ..... 451/38, 39, 40, 451/99, 91, 100; 62/320, 603, 605; 241/83, 89.4

(56) References Cited

U.S. PATENT DOCUMENTS

| | | | | |
|---|---|---|---|---|
| 2,684,207 A | | 7/1954 | O'Brien | |
| 2,767,884 A | | 10/1956 | Gross | |
| 4,718,610 A | | 1/1988 | Gallaher | |
| 5,419,138 A | * | 5/1995 | Anderson et al. | 62/35 |
| 5,473,903 A | * | 12/1995 | Lloyd et al. | 62/35 |
| 5,475,981 A | * | 12/1995 | Becker | 62/35 |
| 5,623,831 A | * | 4/1997 | Mesher | 62/71 |
| 5,785,581 A | * | 7/1998 | Settles | 451/99 |

FOREIGN PATENT DOCUMENTS

| | | |
|---|---|---|
| EP | 1 197 297 A1 | 4/2000 |
| WO | WO 96/01168 | 1/1996 |

* cited by examiner

*Primary Examiner*—Eileen P Morgan
(74) *Attorney, Agent, or Firm*—Hovey Williams LLP

(57) ABSTRACT

System to produce and propel solid sublimable particles, the system comprises at least:

a recipient for receiving solid sublimable material, a plate with an upper face with at least one line of teeth for contacting said material, a means for driving into rotation the plate, and a system for propelling the particles.

20 Claims, 3 Drawing Sheets

MACHINE TO PRODUCE AND PROPEL SUBLIMABLE SOLID PARTICLES

FIELD OF THE INVENTION

The present invention relates to the production and propelling of solid sublimable particles. The machine comprises at least:

a system for producing or calibrating sublimable solid particles; and a system for receiving said sublimable solid particles and for moving said particles to an outlet for ejecting or blasting sublimable particles.

Such a system is suitable for an easy cleaning of inaccessible parts without additional residues.

THE PRIOR ART

In the present specifications, the wording "sublimable solid particles" means particles made of a material that permits sublimation at the temperature and pressure of the object to be cleaned, on which said particles are propelled or blasted. These particles are advantageously made of solidified gas at a temperature lower than 20° C., in particular lower than 0° C., preferably at a temperature lower than −20° C. Those particles are for example particles of $CO_2$ or containing solid $CO_2$.

EP-A-07689334 (corresponding to U.S. Pat. No. 5,520,572) discloses a machine to produce and propel sublimable solid particles on demand. The machine comprises a horizontal chamber containing $CO_2$ blocks, a mechanical pushing mechanism, a granulation system with long knives, a transmission to have them turning in a vertical plane, a mechanical feeding system pushing $CO_2$ pellets on the granulation system, a duct to bring the particles to a distributor conveying the particles in a duct provided with a propelling gas feeding, and an exhaust nozzle mounted on the end of the latter duct.

In this machine, knives act on blocks of solid $CO_2$, for cutting solid $CO_2$ slices which are converted or broken into granules of variable size or length. This machine is also very expensive, as it required a system for pushing horizontally the blocks of $CO_2$ on the knives. This machine is also too heavy to be carried by a person on his back.

Furthermore, the EP-A-0768934 machine also cannot work in a continuous way, as the pushing system must be removed for refilling the chamber with $CO_2$. For limiting the refilling problem, the chamber has a high volume so as to have a sufficiently long working time, this rendering the machine heavy.

Finally, as only slices of material are cut during the working of said machine, it means that a large portion of the particles do not have a sharp edge, such an edge being advantageous, for example, for a specific cleaning operation, such as the cleaning of paint.

U.S. Pat. No. 5,071,289 (corresponding to WO9109800) discloses a system for moving particles by means of a blasting gas, said particles issuing from a hopper provided with a stirring means. Such a system can be used for propelling sublimable solid particles. This document does not disclose the preparation of the solid particles to be blasted out.

BRIEF DESCRIPTION OF THE INVENTION

The present invention relates to a machine having one or more advantages with respect to the system of the state of the art. Said advantages will be disclosed hereinafter.

A first object of the invention is a system for producing and propelling solid sublimable particles, said system comprising at least:

a first means for producing solid sublimable particles;

a second means connected to said first means, said second means receiving solid sublimable particles produced by said first means and propelling said solid sublimable particles towards an outlet, and at least one duct extending between the first means and the second means for conveying solid sublimable particles produced by the first means to the second means, In the system of the invention, the first means for producing solid sublimable particles comprises:

a container with a first opening adapted for receiving solid sublimable material and a second opening associated to a cutting plate having a face indented to be directed towards the solid sublimable material present in the container and intended to be in contact with said solid sublimable material present in the container, said face being provided with at least one line of teeth associated to at least one passage extending through the cutting plate, means for driving into rotation the cutting plate;

whereby the cutting teeth of the cutting plate driven into rotation are adapted for producing, when contacting solid sublimable material present in the container, solid sublimable particles with an average diameter smaller than 6 mm.

Advantageously, the plate forms at least partly a bottom for the recipient intended to receive sublimable material, so that said sublimable material present in the recipient is at least moved towards the plate by gravity.

Preferably, the plate is provided with teeth adapted for shaving the sublimable material present in the container into sublimable particles with an average size comprised between 0.1 mm and 5 mm, for example an average particle size between 0.5 and 4 mm.

Preferably, the plate is provided with a series of independent teeth or teeth which are distant from each other, whereby a better control of the size of the particles can be obtained. The maximum size of the particles can thus be controlled by selecting teeth with appropriate cutting edge and section of passage through the plate.

By using two or more different types of teeth, it is possible to produce a mixture of particles comprising two or more different fractions of particles, said fractions having different mean particle sizes.

According to an embodiment, the plate forms at least partly a bottom for the recipient intended to receive sublimable material, so that said sublimable material present in the recipient is at least moved towards the plate by gravity, and in which the plate is provided with teeth adapted for shaving the sublimable material present in the container into sublimable particles with an average size comprised between 0.1 mm and 3 mm. Most preferably, the solid sublimable material is substantially only moved towards the plate by the force of gravity. In the preferred embodiment, there is no mechanical means for pushing the solid sublimable material towards the plate, whereby during the working of the system, the container can be refilled, making continuous work possible.

According to a detail of an embodiment, the plate is substantially circular and is provided with a series of lines with teeth, each line of teeth extending substantially along a radial direction of the substantially circular plate.

According to another detail of an embodiment, the teeth have a free cutting line extending above the face of the plate intended to be in contact with the sublimable material present in the container, said free cutting line having a shape selected among the group consisting of U-shape, V-shape, a triangle, a square, a rectangle, a half hexagon, a half trapeze, a half octagon, a half pentagon, a half ellipse and combination of these shapes, said teeth being provided with means for guiding the formed particles towards the passages provided in the plate.

Preferably, the plate has at least one line of teeth adapted to form particles with a shape having at least one sharp edge.

According to a specific embodiment, the plate is provided with at least a first series of teeth and a second series of teeth, the teeth of the first series defining a first series of circular working paths during the driving into rotation of the plate, while the teeth of the second series defines a second series of circular working paths, at least one circular path of the second series being located between two adjacent circular working paths of the first series.

Preferably, in this embodiment, the plate is provided with sufficient teeth with different circular working paths, whereby the plate has a substantially continuous teeth working zone corresponding to a major portion of the face of the plate intended to be in contact with the sublimable material present in the container.

According to an advantageous detail of an embodiment, the system further comprises at least a scraping means working with the plate. For example, the system further comprises at least a scraping means working with the face of the plate intended to be in contact with the sublimable material present in the container.

The teeth of the plate are made to produce particles, with an average diameter below 6 mm, from the original sublimable solid material or blocs present in the recipient. The teeth are made to permit the sublimable solid particles to pass trough the plate, when this one is turning. The sublimable solid particles made this way have an average diameter between 0.1 and 6 mm, in particular an average diameter between 0.15 et 4 mm. The diameter of the sublimable solid particles can be single or mixed (example: having a large part of small sublimable solid particles and a smaller part of larger sublimable solid particles). The mixed sublimable solid particles having a better cleaning effect on thick layers of dust.

The plate presents teeth made for shaving the sublimable solid material in smaller particles.

Preferably, the teeth are placed in successive lines, each line extending preferably along a radius of the plate. The plate having for example 4 or more than 4, advantageously 6 or more than 6, preferably 8 or more than 8 lines of teeth.

The teeth of the plate are advantageously situated so they shave on a different diameter of the plate. There is preferably at least one tooth on every radius of the plate, or for a major portion thereof.

According to an embodiment, the plate has at least 2 lines of teeth. The teeth of the first line, shaving on a different radius than the teeth of the second line. By placing the teeth of those lines and the inclination of the teeth, it is possible to create a centrifugal or centripetal force for the sublimable solid material at plate level.

Preferably, the plate presents at least one line of teeth, adapted to have at least one cutting line in contact with the sublimable solid material, for example defined between two flat faces making an angle of 90° or less (for example less than 60° even less than 45°) between them, the teeth producing sublimable particles with an irregular, but substantially spherical shape (see FIG. 17).

The driving means of the plate (i.e. the means for driving into rotation the plate) is for example a system permitting to regulate or to control the rotation speed of the plate. The rotation speed of the plate can for example be regulated or controlled between 1 round/minute and 500 rounds/minute, in particular between 5 et 100 rounds/minute, advantageously between 10 et 75 rounds/minute. The regulation of the speed can be continuous or progressive and/or discontinue or with predetermined steps. The speed of the plate will depend also of the diameter of the plate, the number of teeth, the size of the teeth, the form of the teeth, etc.

The means for preparing solid sublimable particles from the material can also be used in existing machine, such as the machine disclosed in the prior art. It means that the means for preparing solid sublimable particles, as disclosed in the system of the invention, can be associated to any means suitable for propelling the particles towards an outlet or a nozzle.

The invention relates also to a method for treating at least one face of an object by blasting sublimable particles on said face by means of a system comprising at least:

- a first means for producing solid sublimable particles;
- a second means connected to said first means, said second means receiving solid sublimable particles produced by said first means and propelling said solid sublimable particles towards an outlet, and
- at least one duct extending between the first means and the second means for conveying solid sublimable particles produced by the first means to the second means, in which the first means for producing solid sublimable particles comprises:

- a container with a first opening adapted for receiving solid sublimable material and a second opening associated to a plate having a face intended to be directed towards the solid sublimable material present in the container and intended to be in contact with said solid sublimable material present in the container, said face being provided with at least one line of teeth associated to at least one passage extending through the plate,
- means for driving into rotation the plate.

Said method comprises at least the step of:

- introducing solid sublimable material in the container whereby said sublimable material contact a face of the plate provided with teeth;
- driving into rotation the plate so as to extract solid sublimable particles from the solid sublimable material present in the container; said solid sublimable particles passing through the plate and falling in the duct conveying the solid sublimable particles in the second means for propelling said particles towards an outlet,
- expelling solid sublimable particles from the outlet towards the object to be treated, whereby the teeth are selected so as to form sublimable particles with an average size of less than 6 mm.

Advantageously, the solid sublimable material placed in the container is moved at least by the force of gravity, preferably substantially only by said force of gravity, towards the plate provided with teeth.

Preferably, the solid sublimable material is moved vertically in the container towards the plate.

According to an embodiment, the solid sublimable particles have an average size comprised between 0.1 and 5 mm, advantageously between 0.1 and 3 mm.

Preferably, a plate with adapted teeth is used to make sublimable solid particles with a shape with faces forming therebetween an angle or a shape edge.

For example, the solid sublimable material placed in the container is selected from the group consisting of blocs, granules, sticks, pellets and combinations thereof, said material having a size greater than 2 mm, advantageously greater than 6 mm, such as about 8 mm, 10 mm or even more.

The blocs, granules, sticks or pellets can have various average diameters from 2 mm to more than 250 mm. The sublimable solid particles made has an average diameter between 0.1 and 6 mm. The particles can be formed in one or more turns of the teeth, to let them go trough the plate. Advantageously, we use blocs, granules, sticks or pellets containing solid $CO_2$ to create sublimable solid particles with an average diameter inferior to 6 mm. Preferably, blocs, granules or pellets or sticks of $CO_2$ are used. Other forms of solid $CO_2$ material can also be used.

Preferably, a plate with adapted teeth is used to make sublimable solid particles with at least one angle or sharp edge.

Following a characteristic of an advantageous procedure of the invention, at least gravity is pushing the blocs, granules, sticks or pellets to the plate with teeth. Preferably, only gravity is pushing the blocs, sticks, granules or pellets to the plate with the teeth.

Particularities and details of the invention are explained in the detailed description below, with references to the drawings in attachment.

DESCRIPTION OF PREFERRED EMBODIMENT

Figure 1:
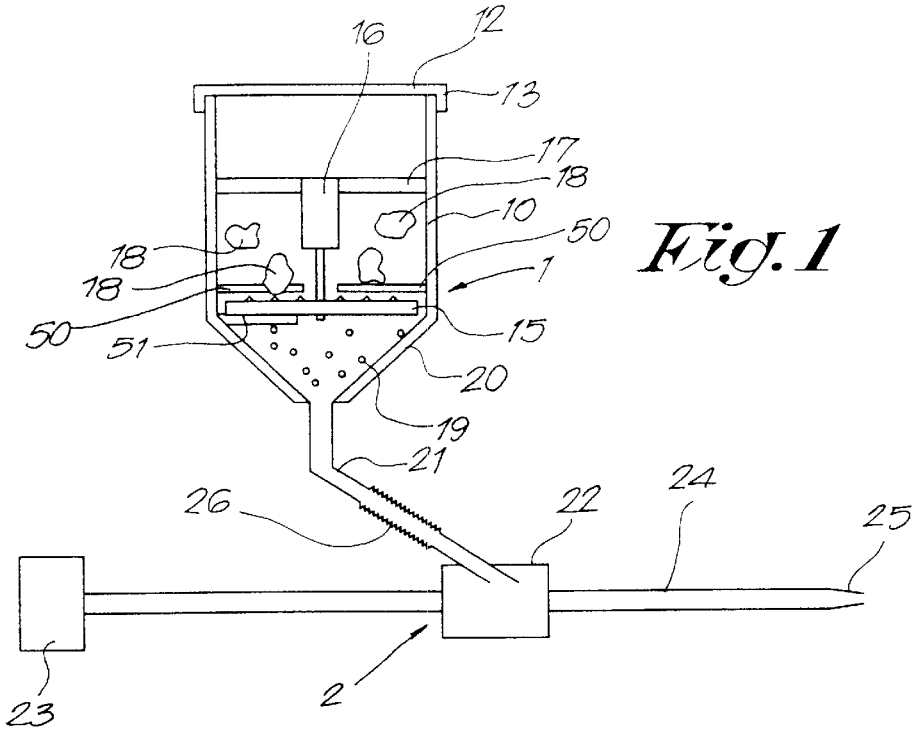
FIG. 1 is a schematic view of the invention.

The system shown in FIG. 1 comprises:

a system 1 to produce sublimable solid particles; and a system 2 receiving the formed sublimable solid particles and in which these particles are propelled to an outlet or blasting end 25 advantageously equipped with a projection system or nozzle or blasting head, for example a means for directing the escape of the particles.

The system for preparing the sublimable solid particles comprises:

a recipient or container or holder 10 for receiving sublimable solid material, such as one or more blocks of sublimable solid material, the recipient or container 10 being also provided with an insulating layer 11 and a cover 12 with an insulating layer, a system 16 for driving in rotation the plate 14, this system including for example an electric or pneumatic motor extending into or out of the container by means of a support 17.

The particles 19 of sublimable solid material formed by the action of the teeth 15 of the rotating plate on the blocks or pellets 18 placed in the recipient 10 pass or flow through the plate 14 (via the passage 15A) to fall into an insulated funnel 20. The bottom of the funnel 20 communicates through a conduit 21 with a distributor 22 in which the particles 19 are carried away with a compressed air flow (coming from a source 23) in a conduit 24 with a blasting head or controlled expelling end 25. The conduit 21 is advantageously equipped to be flexible or with a flexible part 26.

The teeth 15 of the plate 14 are adapted for forming particles with a weight average particle size of less than 6 mm from the blocks or granules present in the recipient when the plate is driven into rotation. The teeth are associated with one or more passages allowing the particles to move through the plate.

The pellets or blocks of sublimable solid material placed in the recipient 10 are pushed by the plate 14 by the force of gravity. It has been observed that, when using only the force of gravity for moving and pushing pellets, sticks, granules or blocks of $CO_2$ of the recipient towards the plate 14, a good production of particles with an average diameter below 6 mm could be ensured, this production being easier while not requiring a pusher for applying important forces for pushing the pellets, sticks, granules or blocks on the plate 14, the system following the invention is less heavy, and can therefore easily be carried by a worker, for example on the back of the worker. According to a possible advantageous embodiment, the system of the invention can be carried on the back of the user by means of an appropriate bearing system, such as a system comporting one or more strips or straps (for example, a system similar to the system used for a rucksack or backpack).

Figure 8:
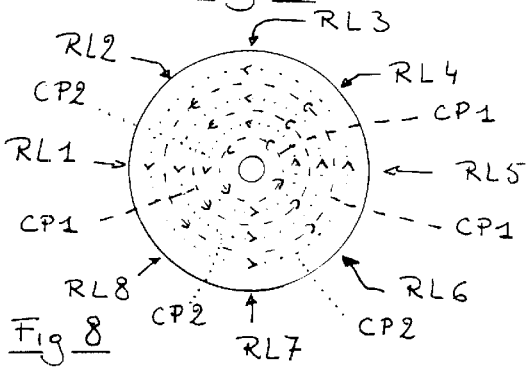
FIG. 8 is a top plan view of a cutting plate with eight radial lines of teeth.
Figure 17:
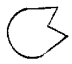
FIG. 17 is an enlarged view of a sublimable particle shown in FIG. 1 having a shape with a sharp edge.

The plate 1 (see FIG. 8) is provided on its upper face with radial lines RL1,RL2,RL3,RL4,RL5,RL6,RL7,RL8 of teeth 15 (eight radial lines are represented as an example only), each line comprising teeth aligned with a radial of plate 14. The distance between two adjacent teeth is at least 1 mm, advantageously at least 2 mm. The teeth of one line of teeth (RL1,RL3,RL5,RL7) are advantageously not situated on the same radius of the teeth of another line, i.e. the circular paths (CP1, represented in dash lines in FIG. 8) are defined by the rotation of the teeth of a first line do not correspond to the circular paths (CP2, represented in dotted lines in FIG. 8) defined by the rotation of the teeth of a second line (RL2, RL4,RL6,RL8).

Figure 3:
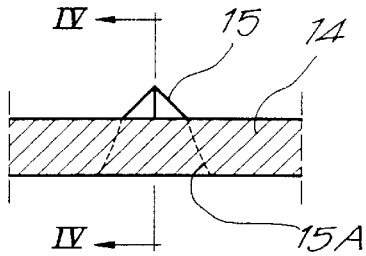
FIG. 3 is an enlarged, fragmentary cross-sectional view of a detail of the plate from FIG. 2.
Figure 6:
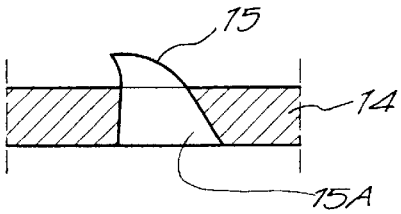
FIG. 6 is a cross-sectional view taken along line VI—VI of a detail from FIG. 5.
Figure 4:
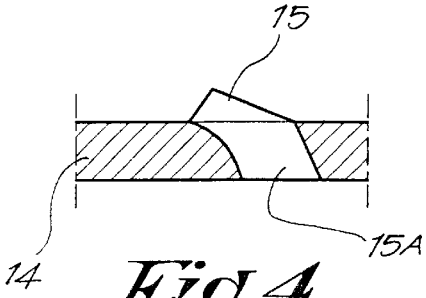
FIG. 4 is a cross-sectional view taken along line IV—IV of the detail from FIG. 3.

The teeth 15 of plate 14 as shown in FIGS. 3 and 4 present a cutting edge defining with the upper face of the plate a triangular shape. The action of such a tooth on a block, pellet, stick or granule provoke an extraction of a particle or particles. However, the pellets, sticks, granules or blocks of $CO_2$ are pushed to the plate only by force of gravity (for example gravity force+the weight of the sublimable solid particle situated above), substantially only $CO_2$ particles passes through the plate. Each tooth 15 is associated with a passage 15A permitting the passage of the produced particles through the plate 14. (see FIGS. 4 and 6).

Figure 5:
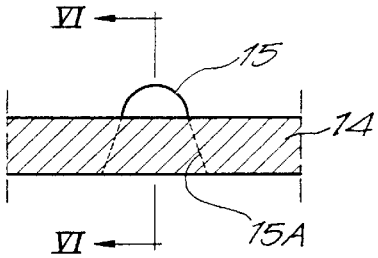
FIG. 5 is an enlarged fragmentary cross-sectional view of an alternative detail for the plate.
Figure 9:
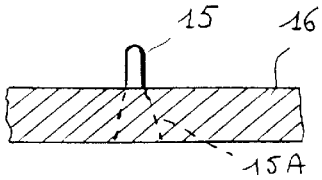
FIG. 9 is a cross-sectional view of a further alternate shape of the teeth of the plate.
Figure 10:
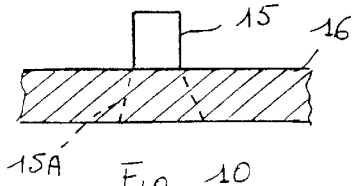
FIG. 10 is a cross-sectional view of another alternate shape of the teeth of the plate.
Figure 11:
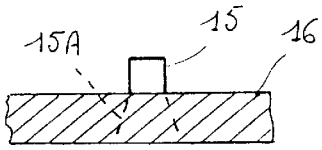
FIG. 11 is a cross-sectional view of another alternate shape of the teeth of the plate.
Figure 12:
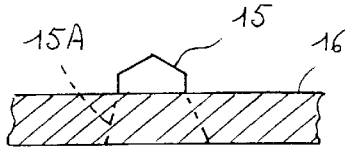
FIG. 12 is a cross-sectional view of another alternate shape of the teeth of the plate.
Figure 13:
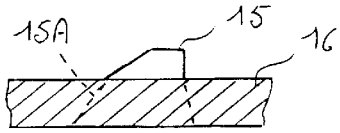
FIG. 13 is a cross-sectional view of another alternate shape of the teeth of the plate.
Figure 14:
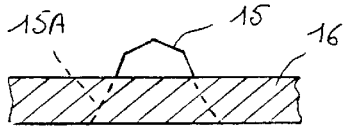
FIG. 14 is a cross-sectional view of another alternate shape of the teeth of the plate.
Figure 15:
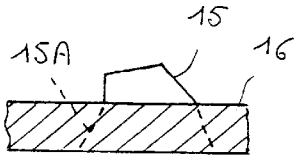
FIG. 15 is a cross-sectional view of another alternate shape of the teeth of the plate.
Figure 16:
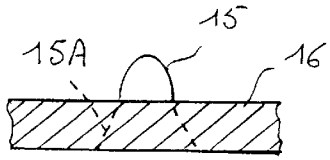
FIG. 16 is a cross-sectional view of another alternate shape of the teeth of the plate.

In the system of FIG. 5, the teeth 15 have a cutting edge suitable for making particles presenting a round shape. Other forms are possible, such as a U-shape (see FIG. 9), a V-shape or a triangular shape (see FIG. 3), a rectangular shape (see FIG. 10), a square shape (see FIG. 11), a half hexagon shape (see FIG. 12), a half trapeze shape (see FIG. 13), a half octagon shape (see FIG. 14), a half pentagon shape (see FIG. 15), a half ellipse (see FIG. 16), etc. It is possible for the rotating plate to be provided with teeth with various shapes.

Figure 7:
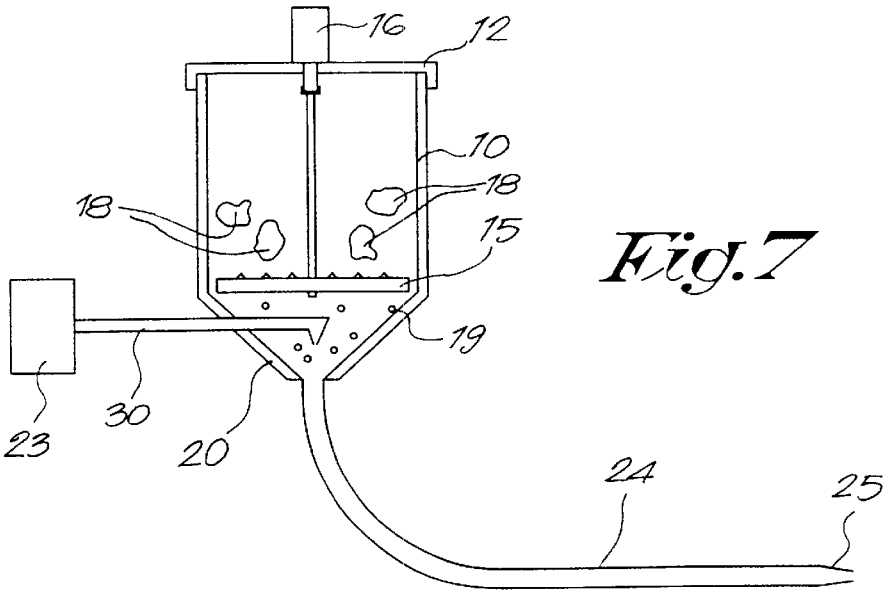
FIG. 7 is a schematic view of another mechanism following the invention.
Figure 2:
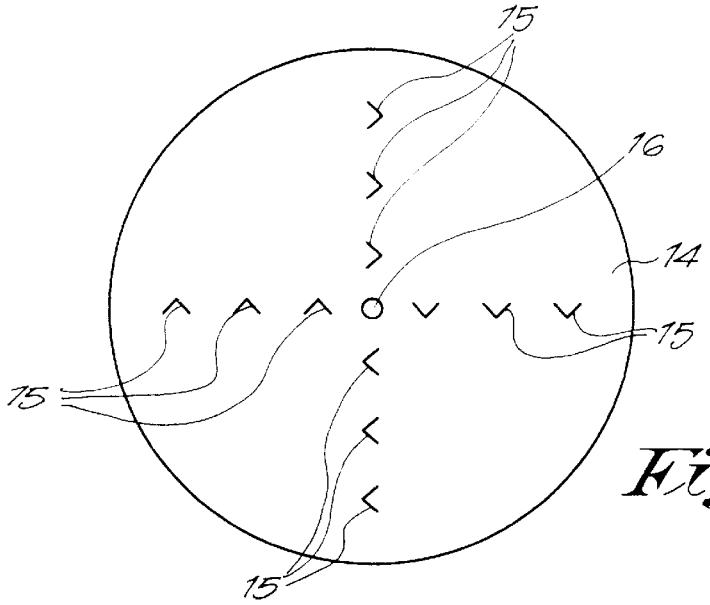
FIG. 2 is a top view of a plate used in FIG. 1.

FIG. 7 is a schematic view of another system according to the invention similar to the system of FIG. 1. In this system, compressed air is introduced by a conduit 30 at the level of the funnel, this compressed air facilitating the flow of the particles 19 to the distributor 22. In this embodiment, all the compressed air required for the expelling of the particles is introduced in the funnel, the funnel being directly connected to conduit 24, the free end of which is provided with a projection head or blasting head 25 is mounted.

The systems schematically shown in FIGS. 1 and 7 have been used producing and propelling the $CO_2$ particles with an average diameter between 0.1 mm et 6 mm, for example approximately 3 mm. It has been observed that when selecting teeth with a specific shape, it was possible to ensure that substantially all the particles had a maximum particle size lower than a predetermined value.

In these systems, pellets or blocks (with different sizes and forms) presenting average diameters between 2 mm and 50 mm (in particular between 5 and 50 mm) to make $CO_2$ particles with a weight average particle size diameter and weight of 3 mm or less. The different batches of $CO_2$ pellets or blocks used had a weight average size respectively of 2 mm, 3 mm, 6 mm, 10 mm, 15 mm, 20 mm, 25 mm, 30 mm and 50 mm. The wording "average weight size" or "average weight particle size" means the average in weight of the equivalent diameter of the particles, pellets or blocks, the equivalent diameter for a particle, block, etc. corresponding to:

6×(Volume of the particle, block, . . . /outer surface area of the particle, block, . . . )

The rotation speed of the plate has been controlled to modify the production quantity of particles brought to the distributor.

The systems of FIGS. 1 and 7 have been used for cleaning surface, electronic components, for disinfecting surfaces, etc., for removing varnish, paint, etc. The particles had a sharp edge (for example by using teeth with an open triangular shape), such an sharp edge being quite appropriate for reaching excellent cleaning result.

The distributor 23 is advantageously a system with venturi. Possibly, the funnel 20 can be associated to a venturi system for ensuring a better and easy flow of the particles in the conduit 21.

The compressed air used for the flow and the expelling or blasting of the particles on a face or surface to be treated is, for example, air with a pressure higher than $2\times10^5$ Pa, for example a pressure between $3\times10^5$ and $20\times10^5$ Pa, in particular between $4\times10^5$ and $10\times10^5$. This compressed air is preferably dry and advantageously cold to limit the sublimation of the $CO_2$ particles in the system. In case the compressed air is not cold, a portion of the $CO_2$ particles can sublimate in conduit 24, to cool down the temperature of the air.

At the projection or blasting head, that can have a flat form or not, the particles come out with a sufficient velocity or speed to hit violently the surface to treat, the particles will sublimate at least partially when contacting the surface to be treated. This velocity can be variable or controlled, for example, between 1 and 100 m/s, in particular between 5 and 50 m/s. It is also possible to adapt this speed, according to the necessities.

Although in the systems of FIGS. 1 and 7, substantially only gravity force is used for moving and pushing the blocks or pellets towards and on the plate, if required an extra system, such as a cylinder with a pusher, etc. can be installed. However, the use of such a supplementary system is not preferred, as it increases greatly the weight and makes it impossible to work continuously.

The system following the invention, especially as represented in the attached figures, is advantageously provided with one or more scrapers 50,51 working near to the plate 14. A scraper can be fixed to the recipient 10. This scraper 50 is advantageously made to scrape the upper face of the plate 14 with the teeth 15 or on the particles or $CO_2$ blocks in contact or near to the upper side of the plate. This scraper 50 can possibly be movable, or turning in the same direction as the plate, but with another speed (for example slower than the plate), or in the opposite rotating direction. Depending on the shaved material it is also interesting to have a scraper 51 on the opposite face of the plate (lower face) to scrap the face opposite to the face 14 with the teeth 15. A system like that is useful to prevent possible agglomeration of particles on this opposite face.

For the examples above, compressed air has been used for propelling the particles. It is evident that other propelling gases can be used, such as nitrogen, gaseous $CO_2$, oxygen (for example if an oxidation of the surface is required or suitable), etc.

What is claimed is:

1. System for producing and propelling solid sublimable particles, said system comprising at least:

a first means for producing solid sublimable particles;

a second means connected to said first means, said second means receiving solid sublimable particles produced by said first means and propelling said solid sublimable particles towards an outlet, and at least one duct extending between the first means and the second means for conveying solid sublimable particles produced by the first means to the second means, in which the first means for producing solid sublimable particles comprises at least:

a container with a first opening and a second lower opening associated to a cutting plate, said first opening being adapted for placing sublimable material in the container above the cutting plate, means for driving into rotation the cutting plate, and a funnel attached to the container, said funnel having a lower end connected to the duct conveying the solid sublimable particles to the second means, and an upper end, at which the cutting plate forms a separation between the funnel and the lower opening of the container, whereby the cutting plate has a lower face directed towards the funnel and an upper face intended to be directed towards the sublimable material placed in the container and is provided with at least one line of cutting teeth, each cutting tooth being associated to at least one passage extending through the plate, whereby, when the cutting plate driven in rotation contacts sublimable material placed in the container, the cutting teeth are adapted for producing solid sublimable particles with an average weight size smaller than about 6 mm, said solid sublimable particles passing directly through the cutting plate into the funnel.

2. The system of claim 1, in which the cutting plate is provided with cutting teeth adapted for shaving the sublimable material present in the container into sublimable particles with an average weight size comprised between 0.1 mm and 5 mm.

3. The system of claim 1, in which the cutting plate is provided with cutting teeth adapted for shaving the sublimable material present in the container into sublimable particles with an average weight size of comprised between 0.1 mm and 3 mm.

4. The system of claim 1, in which the cutting plate is substantially circular and is provided with a series of lines of cutting teeth, each line of cutting teeth extending substantially along a radial direction of the substantially circular cutting plate.

5. The system of claim 1, in which the cutting plate is provided with passages associated to the cutting teeth for enabling the passage of sublimable particles through the cutting plate into the funnel, and in which at least some cutting teeth have a cutting edge extending above the upper face of the cutting plate intended to be in contact with the sublimable material present in the container, said cutting edge having a shape selected among the group consisting of U-shape, V-shape, a triangle, a square, a rectangle, a half hexagon, a half trapeze, a half octagon, a half pentagon, a half ellipse and combination of these shapes, said teeth being provided with means for guiding the formed particles towards the passages provided in the cutting plate.

6. The system of claim 1, in which the cutting plate presenting at least one line of cutting teeth adapted to form sublimable particles having a shape having at least one sharp edge.

7. The system of claim 1, in which the cutting plate is provided with at least a first series of cutting teeth and a second series of cutting teeth, the cutting teeth of the first series defining a first series of circular cutting paths during the driving into rotation of the cutting plate, while the cutting teeth of the second series define a second series of circular cutting paths, at least one circular cutting path of the second series being located between two adjacent circular cutting paths of the first series.

8. The system of claim 7, in which the cutting plate is provided with sufficient cutting teeth with different circular cutting paths, whereby, when driven in rotation, the cutting plate defines a substantially continuous cutting zone corresponding to a major portion of the upper face of the cutting plate intended to be in contact with the sublimable material present in the container.

9. The system of claim 1, which further comprises at least a scraper for scraping a face of the cutting plate, said face of the cutting plate being selected from the group consisting of the lower face and the upper face of the cutting plate.

10. The system of claim 1, which further comprises at least a scraper for scraping the upper face of the cutting plate intended to be in contact with the sublimable material present in the container.

11. Method for treating at least one face of an object by blasting sublimable particles on said face by means of a system comprising at least:

a first means for producing solid sublimable particles;

a second means connected to said first means, said second means receiving solid sublimable particles produced by said first means and propelling said solid sublimable particles towards an outlet, and at least one duct extending between the first means and the second means for conveying solid sublimable particles produced by the first means to the second means, in which the first means for producing solid sublimable particles comprises:

a container with a first opening and a second lower opening associated to a cutting plate, said first opening being adapted for placing sublimable material in the container above the cutting plate, means for driving into rotation the cutting plate, and a funnel attached to the container, said funnel having a lower end connected to the duct conveying the solid sublimable particles to the second means, and an upper end, at which the cutting plate forms a separation between the funnel and the lower opening of the container, whereby the cutting plate has a lower face directed towards the funnel and an upper face intended to be directed towards the sublimable material placed in the container and is provided with at least one line of cutting teeth, each cutting tooth being associated to at least one passage extending through the plate, whereby, when the cutting plate driven in rotation contacts sublimable material placed in the container, and whereby the cutting teeth are selected so as to form sublimable particles with an average weight size of less than about 6 mm, said method comprising the step of:

introducing solid sublimable material in the container whereby said sublimable material contacts the upper face of the cutting plate provided with the cutting teeth;

driving into rotation the cutting plate so as to extract solid sublimable particles from the solid sublimable material present in the container; said solid sublimable particles passing through the cutting plate into the funnel and falling in the duct conveying the solid sublimable particles in the second means for propelling said particles towards an outlet, expelling solid sublimable particles from the outlet towards the object to be treated.

12. The method of claim 11, in which the solid sublimable material placed in the container is moved at least by the force of gravity towards the cutting plate provided with cutting teeth.

13. The method of claim 11, in which the solid sublimable material is moved vertically in the container towards the cutting plate.

14. The method of claim 11, in which the solid sublimable particles have an average weight size comprised between 0.1 and 5 mm.

15. The method of claim 11, in which the solid sublimable particles have an average weight size comprised between 0.1 and 3 mm.

16. The method of claim 11, in which the solid sublimable particles have an average weight size comprised between 0.1 and 1 mm.

17. The method of claim 11, in which the teeth of the cutting plate are selected so as to produce solid sublimable particles with a shape having at least one sharp edge.

18. The method of claim 11, in which the solid sublimable material placed in the container is selected from the group consisting of blocs, granules, pellets and combinations thereof, said material having a size greater than 2 mm.

19. The method of claim 11, in which the solid sublimable material placed in the container is selected from the group consisting of blocs, granules, pellets and combinations thereof, said material having a size greater than 6 mm.

20. The method of claim 11, in which solid sublimable material is added in the container during the driven into rotation of the cutting plate.

* * * * *